US006749060B2

(12) United States Patent
Ford

(10) Patent No.: US 6,749,060 B2
(45) Date of Patent: Jun. 15, 2004

(54) DISPLAY PACKAGE FOR VENDING COMBINATION OF A WRIST-WATCH AND A WALLET OR BILLFOLD

(75) Inventor: Allan L. Ford, Melrose Park, PA (US)

(73) Assignee: Reborn Products, Co., Inc., Bensalem, PA (US)

( * ) Notice: Subject to any disclaimer, the term of this patent is extended or adjusted under 35 U.S.C. 154(b) by 180 days.

(21) Appl. No.: 10/072,053

(22) Filed: Feb. 8, 2002

(65) Prior Publication Data

US 2003/0150749 A1 Aug. 14, 2003

(51) Int. Cl.[7] ..... B65D 69/00

(52) U.S. Cl. ..... 206/223; 206/299; 206/779; 206/296

(58) Field of Search ..... 206/223, 736, 206/737, 756, 757, 6.1, 301, 299, 770, 779, 296, 459.5, 460, 278; 211/85.2

(56) References Cited

U.S. PATENT DOCUMENTS

| | | | | | |
|---|---|---|---|---|---|
| 1,633,417 | A | * | 6/1927 | Perry | 206/5 |
| 1,740,134 | A | * | 12/1929 | Winston | 206/5 |
| 2,458,567 | A | * | 1/1949 | Cramer | 206/5 |
| 2,642,986 | A | * | 6/1953 | Grosvenor | 206/5 |
| 3,794,793 | A | * | 2/1974 | Rius | 206/760 |
| 4,401,209 | A | * | 8/1983 | Salmond et al. | 206/5 |
| 4,682,310 | A | | 7/1987 | Lund et al. | |
| 4,986,426 | A | * | 1/1991 | Niklaus | 211/85.2 |
| 5,003,637 | A | * | 4/1991 | Lonon | 2/160 |
| D329,540 | S | * | 9/1992 | Kunes et al. | D12/417 |
| 5,341,972 | A | | 8/1994 | Jacks | |
| 5,503,269 | A | * | 4/1996 | DeBiasio | 206/296 |
| 5,697,502 | A | * | 12/1997 | Linz | 206/779 |
| 5,772,039 | A | | 6/1998 | Orr et al. | |
| 6,053,326 | A | | 4/2000 | Ford | |
| 6,471,053 | B1 | * | 10/2002 | Feibelman | 206/6.1 |

* cited by examiner

*Primary Examiner*—Jila M. Mohandesi
(74) *Attorney, Agent, or Firm*—Caesar, Rivise, Bernstein, Cohen & Pokotilow, Ltd.

(57) ABSTRACT

A display package for holding a wrist-watch and a wallet or billfold. The package is formed of a generally planar strip of foldable material having a first and second fold lines forming a front panel, a rear panel, and an intermediate panel. The panels are disposed with respect to each other and foldable along respective fold lines to form an interior space into which the wallet/billfold can be inserted. The rear panel includes a pair of openings through which the band of the wrist-watch can be extended to surround the package with the wallet/billfold therein. At least one of the front and rear panels includes advertising indicia and the front panel includes an opening to suspend the display package.

18 Claims, 3 Drawing Sheets

DISPLAY PACKAGE FOR VENDING COMBINATION OF A WRIST-WATCH AND A WALLET OR BILLFOLD

BACKGROUND OF THE INVENTION

This invention relates generally to a packaging, and more particularly to a display package for vending the combination of a wrist-watch and a wallet or billfold.

The combining of a wallet or billfold and a timepiece has been disclosed in the patent literature. For example, in U.S. Pat. No. 4,682,310 (Lund et al.) there is disclosed a timepiece that may be associated with a billfold in which the incorporation of the timepiece into the billfold does not significantly affect either the configuration or usage of the billfold. The timepiece is in the form of a battery-powered digital watch includes a printed circuit-board that is oversized to provide a flange that extends beyond the periphery of the watch cover. The billfold into which the timepiece is to be incorporated includes a cutout in its cover or a pocket sized to receive the cover member of the watch to permit viewing of the digital display, but to prevent the flange from passing therethrough. The timepiece is secured in place by an adhesive-bearing web overlying the backsides of both the flange and the wallet member through which the watch is viewed. Alternatively, or additionally, adhesive may be applied to the front-side of the flange that interfaces with the backside of the wallet member.

In U.S. Pat. No. 5,341,972 (Jacks) there is disclosed a wrist watch wallet having a main band with a watch attached to the outer surface thereof. The main band is designed to conveniently store in a concealed manner such items as currency, keys, and event tickets. The main band is made of thin, flexible, fashionable material and has sufficient length so that it may be wrapped in an overlapping manner around the user's wrist. Attached to the opposite ends of the main band are complimentary primary hook and loop connector pads which are interconnected to hold the main band in place around the user's wrist. During manufacturing, a longitudinally aligned full length opening is formed on the rear surface of the main band which allows access to the full length, longitudinally aligned main pocket formed therein. One end of the main band is closed while the opposite end is opened thereby providing a transversely aligned opening into the main pocket. Attached along the closed end of the main band is a inward curved, rigid insert member which acts to improve the gripping strength of the primary hook and loop connector pads during use. Also manufactured inside the main band is an optional second pocket used to carry smaller objects. Key pockets are also provided for carrying keys.

The combining of a timepiece and a wallet or billfold into one unit, such as disclosed in the above identified patents, may be desirable for some purposes, e.g., to add value to the combination. However, such an arrangement has several drawbacks. For example, it is not conducive for using each in its most common manner, e.g., using the time-piece as a wrist-watch. Moreover, the wallet/billfold has to be specially constructed to be adapted to hold the timepiece, thereby increasing its complexity and rendering it more bulky. Thus, while the vending of these two items together may be desirable, it should be done in a manner that enables each to be used in its normal manner. Heretofore this has not been addressed or achieved by prior art packaging.

In particular, the prior art includes packaging for a wallet or billfold alone, but not packaging for a wallet or billfold and a watch to be sold together. With respect to the former type of packaging see for example, my U.S. Pat. No. 6,053,326. In that patent there is disclosed a packaging system and method of packaging for a foldable wallet or billfold to enable the wallet or billfold to be opened and examined while deterring the wallet or billfold from being removed from the packaging system. U.S. Pat. No. 5,772,039 (Orr et al.) also discloses a packaging system for displaying articles, such as wallets, in a manner such that the wallets are readily accessible to shoppers, but are relatively difficult to shoplift.

Thus, a need exists for a vending package for holding or otherwise supporting a conventional foldable wallet or billfold and a conventional wrist-watch, so that those items can be sold as a unit and then used separately in their respective normal usage modes.

SUMMARY OF THE INVENTION

A display package for vending the combination of a wrist-watch and a wallet or billfold. The wrist-watch comprises a pair of straps adapted to be releasably connected to each other to form a band for holding the watch on the wrist of a person. The wallet/billfold comprises at least two sections foldably connected to each other.

The package basically comprises a front panel, a rear panel, and an intermediate panel connected together. Each of the panels has a pair of side edges, a top edge and a bottom edge. The panels are disposed with respect to each other so that the wallet/billfold is located with one of its sections behind the front panel, and with the other of its sections located in front of the rear panel and with the intermediate panel interposed between the two sections of the wallet/billfold. One of the front panel and rear panel includes a pair of openings therein through which the band of the wrist-watch can be extended, so that the band extends through those openings, about the side edges of the front and rear panels and about the wallet/billfold.

In accordance with one exemplary preferred embodiment of this invention the bottom edge of the front and rear panels are connected to each other and the top edge of the rear and intermediate panels are connected to each other, e.g., the package comprises a generally planar strip of foldable material having a first fold line and a second fold line, with the first fold line defining the bottom edge of the front and rear panels, and with the second fold line defining the top edge of the rear and intermediate panels.

DESCRIPTION OF THE DRAWINGS

The features and many of the attendant advantages of this invention will become readily appreciated as the same becomes better understood by reference to the following detailed description, when considered in connection with the accompanying drawing, wherein.

DETAILED DESCRIPTION OF THE PREFERRED EMBODIMENT

Figure 1:
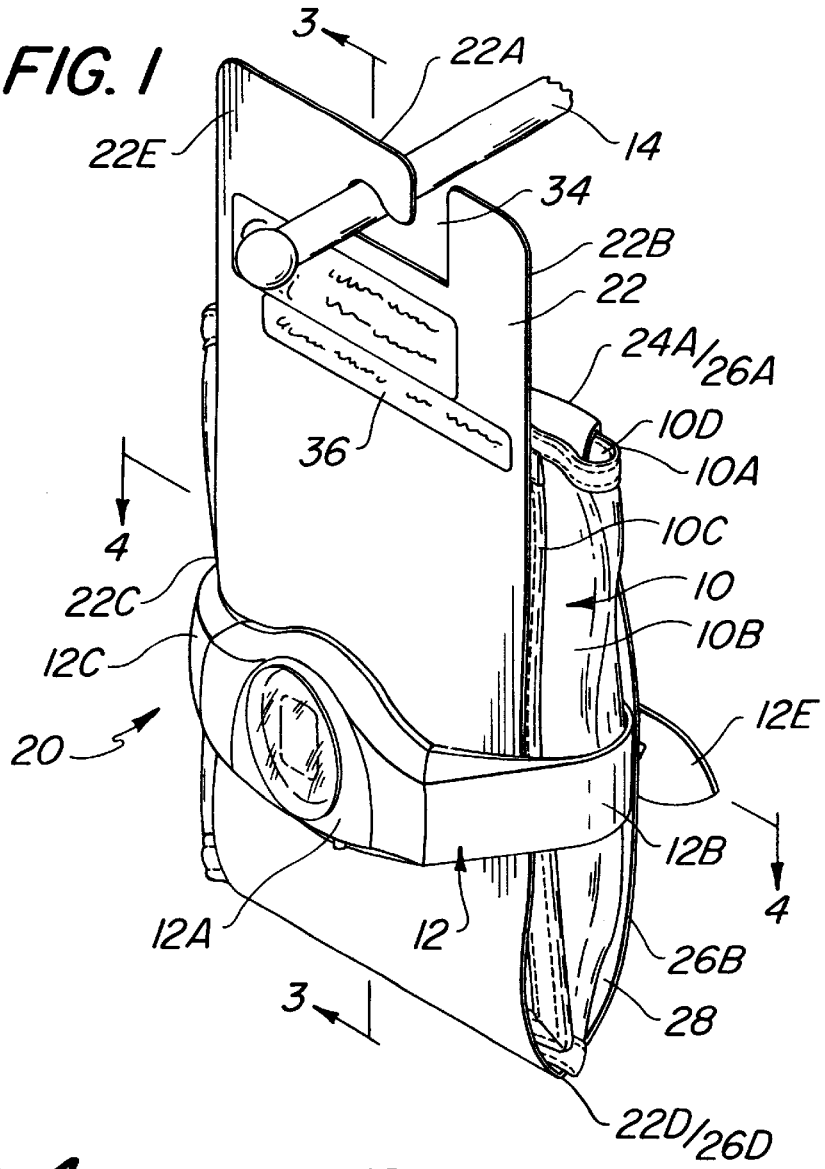
FIG. 1 is an isometric view of one preferred exemplary embodiment of a display package for vending the combination of a wrist-watch and a wallet/billfold, with the package being shown suspended from a conventional display panel hook.

Referring now in greater detail to the various figures of the drawing, wherein like reference characters refer to like parts, a package embodying the present invention is generally shown at 20 in FIG. 1 for holding a foldable wallet or billfold 10 between portions of the package 20 while also holding a conventional wrist-watch 12 extending about and through portions the package 20. Before discussing the details of the package 20, a brief discussion of the wallet/billfold 10 and the wrist-watch 12 that may be held for display by the package 20 is in order.

In the embodiments shown herein the wallet/billfold 10 is of a tri-fold design. That is, it includes three rectangular sections 10A, 10B and 10C. The sections are integral with one another, with the section 10B forming one end of the wallet/billfold, the section 10A forming the other end of the wallet/billfold, and with the section 10C being located between the sections 10A and 10B. Each section is of the same size and shape. The sections are arranged to be folded along respective fold-lines separating them so that the section 10A forms the front of the wallet/billfold and overlies the section 10B, and with the section 10B overlying the section 10C. Thus, the section 10C forms the rear of the wallet/billfold. Each of the sections includes a pocket (not shown) which conjoin to form a bill-receiving compartment (not shown) extending the length of the wallet/billfold. The section 10A may, if desired, be smaller (narrower) than the other two sections to form a flap over the section 10B. Releasably securable fastening means, such as VELCRO® fasteners, (not shown), can be used to releasably secure the section 10A onto the underlying section 10B to hold the three sections of the wallet/billfold 10 in a closed state.

It should be pointed out at this juncture that the wallet/billfold 10 may be of a bifold type instead of the tri-fold shape shown. In such a case there will only be two sections 10A and 10B and a single fold line therebetween. Moreover, the wallet/billfold 10 may include compartments or slots for credit cards, identification cards and the like, and may be formed of a multitude of relatively strong and tear-resistant materials, e.g., leather, plastic, fabric, etc.

Figure 4:
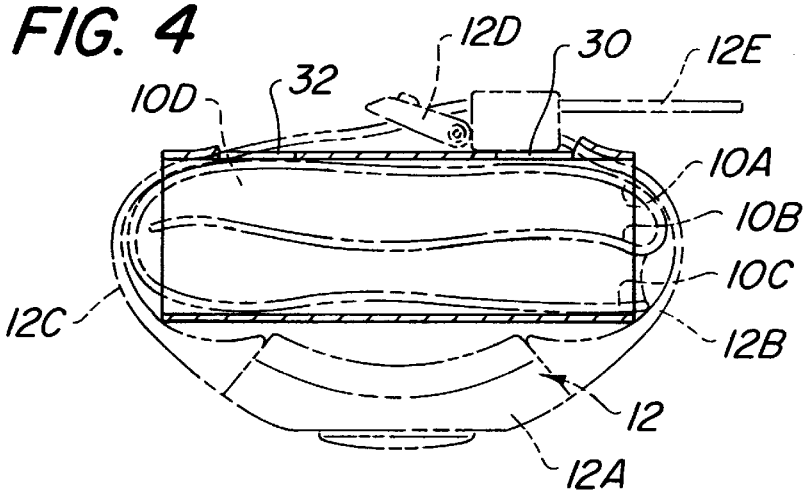
FIG. 4 is a sectional view taken along line 4—4 of FIG. 1, with the wrist-watch and the wallet/billfold being shown by phantom lines.

As can be seen in FIGS. 1 and 4, when the wallet/billfold 10 is folded up its overlapping sections 10A, 10B and 10C form a pair of entryways 10D along the top and bottom edges of the wallet/billfold. It is through the upper one of these entryways 10D that a portion of the package 20 (to be described later) is extended to hold the wallet/billfold in place in the package 20.

The wrist-watch 12 is of a conventional construction and basically comprises a housing 12A containing the watch's time-piece or mechanism and the watch's dial (if an analog watch) or display (if a digital watch) from which the time can be discerned. The watch 12 includes a strap for mounting it on the wrist of a person. The strap includes a pair of strips sections 12B and 12C which are connected on opposite sides of the housing 12A. The strip section 12B includes a buckle 12D on the free end thereof. The strip section 12C includes a plurality of holes (not shown) extending therealong at equally spaced positions from the free end 12E of the strip towards the housing 12A. The holes are arranged to cooperate with the buckle 12D as is conventional to secure the two strips 12B and 12C together to form an encircling band of the appropriate size to accommodate the wearer's wrist.

Figure 2:
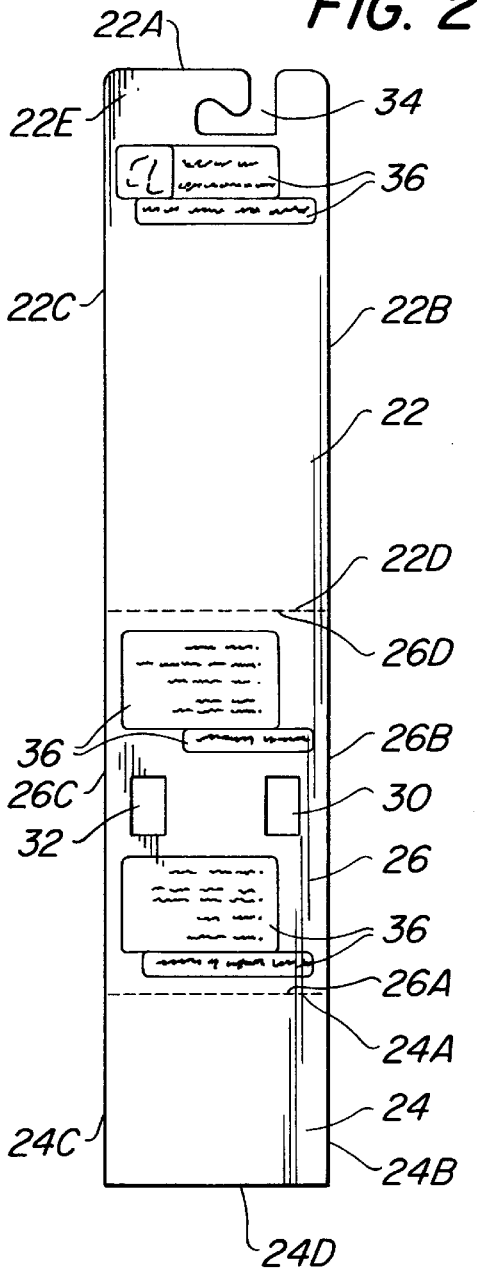
FIG. 2 is a reduced plan view of the display package of FIG. 1 shown in its flat state prior to being folded for mounting the wrist-watch and wallet/billfold thereon.

Referring now to FIG. 2 the package 20 can be seen to basically comprise an elongated rectangular, planar sheet of any suitable, thin material, e.g., paper, cardboard, plastic or some other foldable material. If the sheet is paper or cardboard, it can be coated with a plastic to render it abrasion and tear resistant. The sheet forming the package is preferably an integral member defined by three longitudinally located panels, namely, a front panel 22, an intermediate panel 24 and a rear panel 26. The panels are separated from one another by fold lines (to be described later). The front panel includes a top edge 22A, a pair of side edges 22B and 22C, and a bottom edge 22D. The rear panel 26 includes a top edge 26A, a pair of side edges 26B and 26C, and a bottom edge 26D. The intermediate panel 24 includes a top edge 24A, a pair of side edges 24B and 24C, and a bottom edge 24D. The side edges 22B, 24B and 26B on one side of the sheet are co-linear, as are the side edges 22C, 24C and 26C on the opposite side of the sheet.

The sheet making up the package 20 is foldable along the heretofore mentioned fold lines to form a pocket 28 (FIGS. 1 and 3) for holding the wallet/billfold 10. In particular, the front panel 22 is connected to the rear panel 26 by a foldable fold line defined by the bottom edge 22D of the front panel and the bottom edge 26D of the rear panel 26. The rear panel 26 is connected to the intermediate panel 24 by a foldable fold line defined by the top edge 26A of the rear panel and the top edge 24A of the intermediate panel 24.

Figure 3:
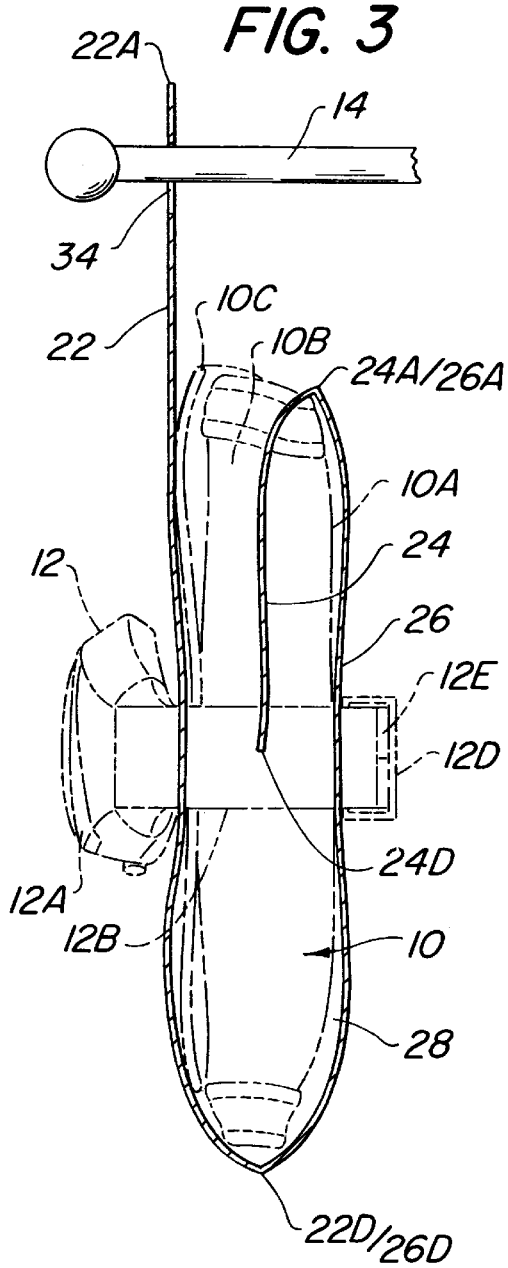
FIG. 3 is a sectional view taken along line 3—3 of FIG. 1, with the wrist-watch and the wallet/billfold being shown by phantom lines.

The panels are arranged to be folded along their fold lines like shown in FIG. 3 to mount the wallet/billfold 10 in the pocket 28 between the front and rear panels 22 and 26, respectively, with the intermediate panel 24 effectively locking the wallet/billfold 10 in place. This can be accomplished in several ways, with the same ultimate result. The following is one such manner. To that end, the sheet making up the package 20 is folded along the coincident lines 22D and 26D so that the front panel 22 overlies the rear panel 26 to form the pocket 28 therebetween. The wallet/billfold 10 is then introduced into the pocket 28 so that one of its entryways 10D is located immediately adjacent the fold line defined by edges 22D and 26D and the other of its entryways 10D is facing upward. The sheet forming the package 20 is then folded along edges 24A and 26A so that the intermediate panel 24 is directed downward and into the entryway 10D of the wallet/billfold.

As will be appreciated by those skilled in the art the disposition of the intermediate panel 24 through the entryway 10D between the panels immediately adjacent sections 10B and 10C of the wallet/billfold effectively "locks" the wallet/billfold in place against lateral displacement through the open sides of the pocket 28 or out the top of the pocket.

The package 20 is arranged to mount and releasably support the wrist-watch on it encircling the wallet/billfold as shown in FIG. 1. In order to enable the package to securely hold the wrist-watch on it, and to deter theft of the wrist-watch from the package, the package 20 includes a pair of openings through which portions of the wrist-watch's band are arranged to extend. To that end, as best seen in FIGS. 2 and 4 the rear panel 26 includes a pair of rectangular openings 30 and 32 disposed along a transverse axis approximately half way along the length of the rear panel 26. The openings 30 and 32 are of the same size and rectangular shape to enable respective portions of the band's strip sections 12B and 12C to pass therethrough. For example, the strip section 12B and its buckle 12D is arranged to be extended through the opening 30 from the package's pocket 28 in which the wallet/billfold is located outward to the outer surface of the rear panel 26. In a similar manner the strip section 12C and its free end 12E is arranged to be extended through the opening 32 from the package's pocket 28 outward to the outer surface of the rear panel 26. The buckle 12D and the free end portion 12E of the two strip sections 12B and 12C, respectively, can then be connected together in a conventional manner adjacent the exterior surface of the rear panel between the openings 30 and 32 as best seen in FIGS. 3 and 4. This arrangement disposes the wrist-watch housing 12A on the front panel 22 for ready viewing by a prospective purchaser and prevents the wrist-watch from slipping off of the package.

As should be appreciated by those skilled in the art, the package 20 is particularly suited for displaying it and its contents from any type of vending rack or hook in a retail establishment. To that end, the length of the front panel 22, i.e., the distance between its top edge 22A and its bottom edge 22D is longer than the length of the rear panel 26 so that a portion 22E of the front panel 22 contiguous with the upper edge 22A extends above the upper edge of the rear panel 26. An L-shaped slot 34 is provided in the portion 22E at the front panel's upper edge 22A. The slot 34 is arranged to receive a prong or hook 14 of a conventional display rack (not shown) to suspend the package 20 with the wallet/billfold and wrist-watch therefrom.

Since the package 20 is a vending package its front and/or rear panels preferably include indicia 36 thereon. Such indicia can be text, graphics or combinations of the two, e.g., advertising and promotional material, pricing information, etc.

In one exemplary preferred embodiment of the package 20 of this invention the length of the front panel 22 is approximately 17 mm and the length of the rear panel 26 is approximately 12 mm. The length of the intermediate panel 24 is even shorter than the rear panel 26, e.g., is approximately 6 mm. The width of all of the panels 22, 24 and 26, i.e., the distance between their side edges, is approximately 7 mm.

Figure 5:
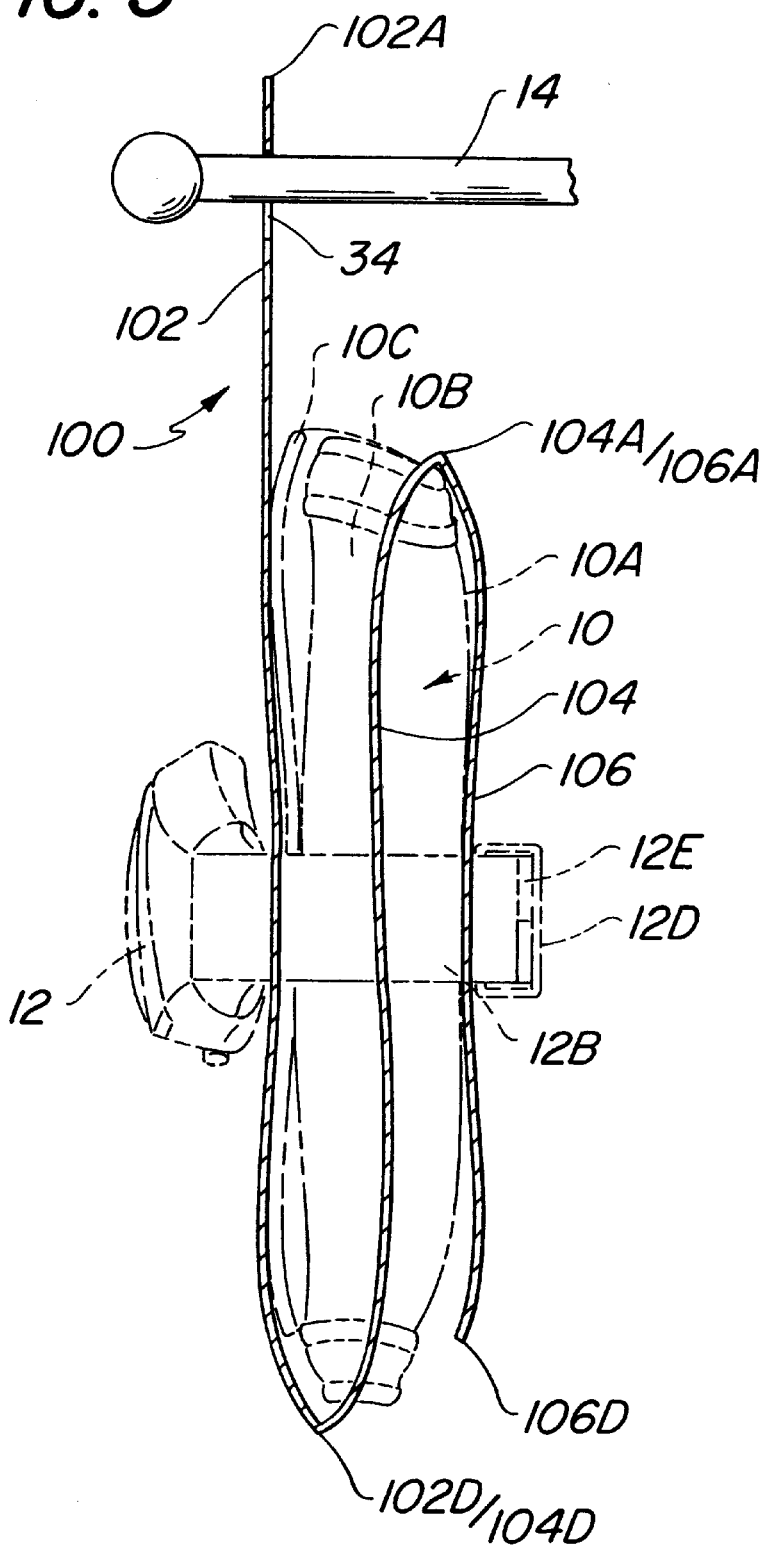
FIG. 5 is a sectional view, like that of FIG. 3, but showing an alternative embodiment of the subject invention.

In FIG. 5 there is shown an alternative embodiment 100 of the package of this invention. In this embodiment, the sheet forming the package 100 is virtually the same as that forming the package 20 described earlier, except for the fact that the intermediate panel is connected directly to the front panel and the rear panel is connected directly to the intermediate panel, so that when the panels are folded they form a zig-zag configuration. To that end, in the package embodiment 100 the front panel is designated by the reference numeral 102 and includes a top edge 102A and a bottom edge 102D. The intermediate panel is designated by the reference numeral 104 and includes a top edge 104A and a bottom edge 104D. The bottom edge 102D of the front panel 102 is connected to the bottom edge 104D of the intermediate panel 104 by a foldable fold line. The rear panel is designated by the reference numeral 106 and includes a top edge 106A and a bottom edge 106D. The top edge 106A of the rear panel 106 is connected to the top edge 104A of the intermediate panel 104 by a foldable fold line. The front and rear panels 102 and 106, respectively, are in all other respects identical to the front and rear panel 22 and 26, respectively, of the package 20. The intermediate panel 104 panel is similar to the intermediate panel 24 of the package 20, except that it is longer in length since it will have to extend fully through and out of the entryways 10D of the wallet/billfold 10 to hold it in place.

The wallet/billfold 10 can be mounted in the package several ways with the same ultimate result. The following is one such manner. In particular, the sheet making up the package 100 is folded along the coincident lines 22D and 26D so that the front panel 102 overlies the intermediate panel 104. The wallet/billfold 10 is placed behind the front panel 102 and the intermediate panel is extended upward through the entryways 10D in the closed (folded) wallet/billfold 10. The rear panel 106 is folded down along the coincident lines 104A and 106A so that it overlies the wallet/billfold. Once this has been accomplished, the wallet/billfold will be located between the front and rear panels 102 and 106, respectively, with the intermediate panel extending fully through the wallet/billfold's entryways 10D. As will be appreciated by those skilled in the art, the disposition of the intermediate panel 104 in the entryways 10D between the panels 10A, 10B and 10C of the wallet/billfold 10 effectively "locks" the wallet/billfold in place against lateral displacement through the open sides of the package 100 or out the top of the package.

The package 100 is arranged to mount and support the wrist-watch on it encircling the wallet/billfold 10 in the identical manner as described with respect to package 20. Thus, the details of that mounting arrangement will not be reiterated in the interest of brevity.

It must be pointed out at this juncture that the length of the various panels making up the packages 20 and 100 can be chosen as desired, depending upon various factors, e.g., the size of the wallet/billfold, etc. Moreover, various material(s) can be used to make up the package. In order to deter theft of the wrist-watch and/or the wallet/billfold from the package, the material(s) used to form the package is preferably at least somewhat tear-resistant.

Without further elaboration, the foregoing will so fully illustrate my invention that others may, by applying current or future knowledge, readily adapt the same for use under various conditions of service.

I claim:

1. A display package for vending the combination of a wrist-watch and a wallet or billfold, the wrist-watch comprising a pair of straps adapted to be releasably connected to each other to form a band for holding the watch on the wrist of a person, the wallet/billfold comprising at least two sections foldably connected to each other, said package being formed of a blank strip of material comprising a first panel, a second panel, and a third panel, each of said panels being a planar member of rectangular shape having a pair of side edges, a top edge and a bottom edge, said panels of said blank strip being disposed with respect to each other and interconnected by respective fold lines, whereupon said blank strip may be folded along said fold lines to form an interior space, with said first and second panels forming an opposed pair of outer boundaries of said interior space and with said third panel being located between said first and second panels and within said interior space, said interior space being adapted to receive the wallet/billfold therein, with one of the sections of the wallet/billfold behind said first panel, with the other of it's the sections of the wallet/billfold being located in front of said second panel and with said third panel being interposed between the two sections of the wallet/billfold, one of said first and second panels including a pair of openings therein each of which is sized to accommodate the band of the wrist-watch, one of said first and second panels being longer than the other of said first and second panels so that a portion of said one of said first and second panels extends beyond the top edge of the other of said first and second panels, said portion of said one of said first and second panels having an opening therein for suspending said package, at least one of said first and second panels having advertising indicia thereon for visibility from the outside of said package.

2. The display package of claim 1 wherein said first panel comprises a front panel of said package, said second panel comprises a rear panel of said package and said third panel comprises an intermediate panel of said package, and wherein the bottom edge of said front panel and said rear panels panel are connected to each other and said top edge of said rear panel and said intermediate panels are connected together.

3. The display package of claim 1 wherein said openings are located in said rear panel.

4. The display package of claim 1 wherein said first panel comprises a front panel of said package, said second panel comprises an intermediate panel of said package and said third panel comprises a rear panel of said package, and wherein the bottom edge of said front panel and said intermediate panel are connected to each other and said top edge of said intermediate panel and said rear panel are connected together.

5. The display package of claim 1 wherein said openings are located in said rear panel.

6. The display package of claim 1 wherein said first and second panels each include advertising indicia thereon.

7. The display package of claim 1 wherein said blank of material of said package is formed of paper-stock.

8. The display package of claim 7 wherein said paper-stock includes a plastic coating.

9. In combination a display package, a wrist-watch and a wallet or billfold, claim said wrist-watch comprising a pair of straps adapted to be releasably connected to each other to form a band for holding the watch on the wrist of a person, said wallet/billfold comprising at least two sections foldably connected to each other, said package comprising a front panel, a rear panel, and an intermediate panel connected together, each of said panels having a pair of side edges, a top edge and a bottom edge, said panels being disposed with respect to each other so that said wallet/billfold is located with one of its sections behind said front panel, and with the other of its sections being located in front of said rear panel and with said intermediate panel being interposed between the two sections of said wallet/billfold, one of said front panel and said rear panel including a pair of openings therein through which said band of said wrist-watch can be extended, so that said band extends through said openings, about the side edges of said front and rear panels and about said wallet/billfold.

10. The combination of claim 9 wherein said bottom edge of said front and rear panels are connected to each other and said top edge of said rear panel and intermediate panels are connected together.

11. The combination of claim 9 wherein said openings are located in said rear panel.

12. The combination of claim 9 wherein one of said front and said rear panel includes an opening for suspending said package.

13. The combination of claim 9 wherein said top edge of said rear and intermediate panels are connected to each other.

14. The combination of claim 9 wherein said front panel includes advertising indicia thereon.

15. The combination of claim 14 wherein said rear panel includes advertising indicia thereon.

16. The combination of claim 9 wherein said package is formed of paper stock.

17. The combination of claim 16 wherein said paper-stock includes a plastic coating.

18. The combination of claim 10 wherein said package comprises a generally planar strip of foldable material having a first fold line and a second fold line, said first fold line defining said bottom edges of said front and rear panels, said second fold line defining said top edges of said rear and intermediate panels.

* * * * *